United States Patent [19]

Kaloi

[11] 4,051,478

[45] Sept. 27, 1977

[54] NOTCHED/DIAGONALLY FED ELECTRIC MICROSTRIP ANTENNA

[75] Inventor: Cyril M. Kaloi, Thousand Oaks, Calif.

[73] Assignee: The United States of America as represented by the Secretary of the Navy, Washington, D.C.

[21] Appl. No.: 740,696

[22] Filed: Nov. 10, 1976

[51] Int. Cl.[2] ..... H01A 9/28; H01A 1/38

[52] U.S. Cl. ..... 343/700 MS; 343/830; 343/846

[58] Field of Search ..... 343/700 MS, 708, 769, 343/829, 830, 846

[56] References Cited

U.S. PATENT DOCUMENTS

| | | | |
|---|---|---|---|
| 3,478,362 | 11/1969 | Ricardi et al. | 343/769 |
| 3,803,623 | 4/1974 | Charlot, Jr. | 343/769 |
| 3,810,183 | 5/1974 | Krutsinger et al. | 343/708 |
| 3,947,850 | 3/1976 | Kaloi | 343/700 MS |
| 3,972,049 | 7/1976 | Kaloi | 343/829 |
| 3,972,050 | 7/1976 | Kaloi | 343/700 MS |
| 3,978,488 | 8/1976 | Kaloi | 343/829 |
| 3,984,834 | 10/1976 | Kaloi | 343/700 MS |
| 3,984,834 | 10/1976 | Kaloi | 343/830 |

*Primary Examiner*—Alfred E. Smith
*Assistant Examiner*—H. Barlow
*Attorney, Agent, or Firm*—Richard S. Sciascia; Joseph M. St. Amand

[57] ABSTRACT

A notched/diagonally fed electric microstrip dipole antenna consisting of a thin electrically conducting, rectangular-shaped element formed on one surface of a dielectric substrate, the ground plane being on the opposite surface. The length of the element determines the resonant frequency. The feed point is in a notch located along the diagonal with respect to the antenna length and width, and the input impedance can be varied to match any source impedance by moving the feed point along the diagonal line of the antenna without affecting the radiation pattern. The antenna bandwidth increases with the width of the element and spacing between the element and ground plane. Singularly fed circular polarization is easily obtained with this antenna.

17 Claims, 8 Drawing Figures

NOTCHED/DIAGONALLY FED ELECTRIC MICROSTRIP ANTENNA

CROSS-REFERENCE TO RELATED APPLICATIONS

This invention is related to U.S. Pat. No. 3,984,834 for DIAGONALLY FED MICROSTRIP DIPOLE ANTENNA issued Oct. 5, 1976; and U.S. Pat. No. 3,947,850 for NOTCH FED MICROSTRIP DIPOLE ANTENNA issued Mar. 30, 1976. This application is also related to copending U.S. Pat. applications:

Ser. No. 740,692 for CIRCULARLY POLARIZED ELECTRIC MICROSTRIP ANTENNAS;

Ser. No. 740,694 for ELECTRIC MONOMICROSTRIP ELECTRIC DIPOLE ANTENNAS;

Ser. No. 740,690 for TWIN ELECTRIC MICROSTRIP DIPOLE ANTENNAS;

all filed together herewith on Nov. 10, 1976 by Cyril M. Kaloi, and commonly assigned.

BACKGROUND OF THE INVENTION

This invention relates to antennas and more particularly to a low physical profile antenna that can be arrayed to provide near isotropic radiation patterns.

In the past, numerous attempts have been made using stripline antennas to provide an antenna having ruggedness, low physical profile, simplicity, low cost, and conformal arraying capability. However, problems in reproducibility and prohibitive expense made the use of such antennas undesirable. Older type antennas could not be flush mounted on a missile or airfoil surface. Slot type antennas required more cavity space, and standard dipole or monopole antennas could not be flush mounted.

SUMMARY OF THE INVENTION

The present antenna is one of a family of new microstrip antennas and uses a very thin laminated structure which can be readily mounted on flat or curved, irregular structures, presenting low physical profile where minimum aerodynamic drag is required. The specific type of microstrip antenna described herein is the "notched/diagonally fed electric microstrip dipole." This antenna can be arrayed with interconnecting microstrip feedlines to each of the element. Therefore, the antenna element and the feedlines can be photoetched simultaneously on a dielectric substrate by processes such as used for producing printed circuits. Using this technique, only one coaxial-to-microstrip adapter is required to interconnect an array of these antennas with a transmitter or receiver. Circular polarization is obtainable in a single notched/diagonally fed element with the use of a single feed point and without the use of phase shifters.

The notched/diagonally fed electric microstrip dipole antenna belongs to the electric microstrip type antenna. The electric microstrip antenna consists essentially of a conducting strip called the radiating element and a conducting ground plane separated by a dielectric substrate. The length of the radiating element is approximately ½ wavelength. The width may be varied depending on the desired electrical characteristics. The conducting ground plane is usually much greater in length and width than the radiating element.

The thickness of the dielectric substrate should be much less than ¼ the wavelength. For thickness approaching ¼ the wavelength, the antenna radiates in a monopole mode in addition to radiating in a microstrip mode.

The antenna as hereinafter described can be used in missiles, aircraft and other type applications where a low physical profile antenna is desired. The present type of antenna element provides completely different radiation patterns and can be arrayed to provide near isotropic radiation patterns for telemetry, radar, beacons, tracking, etc. By arraying the present antenna with several elements, more flexibility in forming radiation patterns is permitted. In addition, the antenna can be designed for any desired frequency within a limited bandwidth, preferably below 25 GHz, since the antenna will tend to operate in a hybrid mode (e.g., a microstrip/monopole mode) above 25 GHz for most commonly used stripline materials. However, for clad materials thinner than 0.031 inch, higher frequencies can be used. The design technique used for this antenna provides an antenna with ruggedness, simplicity, low cost, a low physical profile, and conformal arraying capability about the body of a missile or vehicle where used, including irregular surfaces, while giving excellent radiation coverage. The antenna can be arrayed over an exterior surface without protruding, and be thin enough not to affect the airfoil or body design of the vehicle. The thickness of the present antenna can be held to an extreme minimum depending upon the bandwidth requirement; antennas as thin as 0.005 inch for frequencies above 1,000 MHz have been successfully produced. Due to its conformability, this antenna can be applied readily as a wrap around band to a missile body without the need for drilling or injuring the body and without interfering with aerodynamic design. Further, the antenna can be easily matched to most practical impedances by varying the location of the feed point in a notch along the diagonal of the element.

Advantages of the antenna of this invention over other similar appearing types of microstrip antennas is that the present antenna can be fed very easily from either a coaxial transmission line and a coaxial-to-microstrip adapter from the ground plane side or with a microstrip transmission line etched along with the elements, and has a slightly wider bandwidth for the same form factor.

The notched/diagonally fed electric microstrip dipole antenna consists of a thin electrically-conducting, rectangular-shaped element formed on the surface of a dielectric substrate; the ground plane is on the opposite surface of the dielectric substrate and the microstrip antenna element is fed from etched microstrip transmission line or from a coaxial-to-microstrip adapter with the center pin of the adapter extending through the ground plane and dielectric substrate to the antenna element. The feed point is located along the diagonal line of the antenna element in a notch. The antenna is notched from the outside edge to the optimum feed point. While the input impedance will vary as the feed point is moved along the diagonal line of the antenna element, the radiation pattern will not be affected by moving the feed point. This antenna can be easily matched to most practical impedances by varying the location of the feed point along the diagonal of the element. Also, singularly fed circular polarization can easily be obtained with this notched/diagonally fed antenna. The antenna bandwidth increases with the width of the element and the spacing (i.e., thickness of dielectric) between the ground plane and the element;

the spacing has a somewhat greater effect on the bandwidth than the element width. The radiation pattern changes very little within the bandwidth of operation for the linear polarization configuration.

Design equations sufficiently accurate to specify the important design properties of the notched/diagonally fed electric dipole antenna are included below. These design properties are the input impedance, the gain, the bandwidth, the efficiency, the polarization, the radiation pattern, and the antenna element dimensions as a function of the frequency.

DESCRIPTION AND OPERATION

Figure 1:
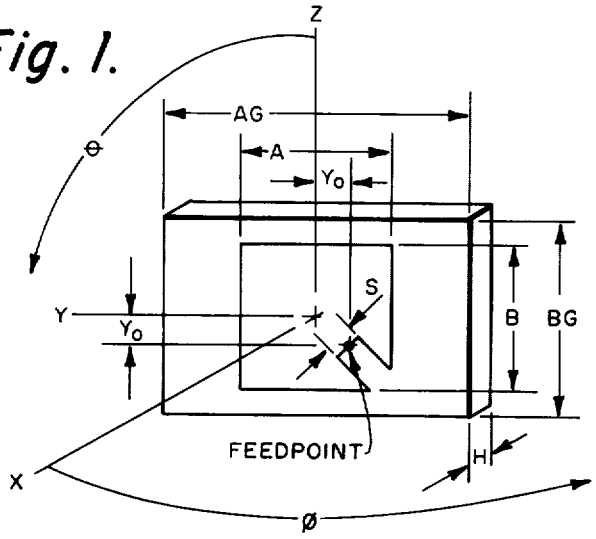
FIG. 1 illustrates the alignment coordinate system used for the notched/diagonally fed electric microstrip dipole antenna.
Figure 3:
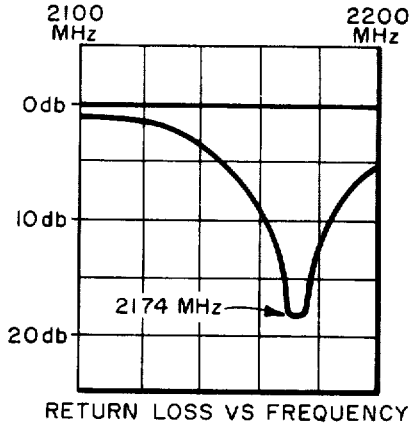
FIG. 3 is a plot showing the return loss versus frequency for the notched/diagonally fed antenna having the dimensions shown in FIGS. 2A and 2B.

The coordinate system used and the alignment of the antenna element within this coordinate system are shown in FIG. 1. The coordinate system is in accordance with the IRIG (Inter-Range Instrumentation Group) Standards and the alignment of the antenna element was made to coincide with the actual antenna patterns that will be shown later. The B dimension is the width of the antenna element. The A dimension is the length of the antenna element. The H dimension is the height of the antenna element above the ground plane and also the thickness of the dielectric. The AG dimension and the BG dimension are the length and the width of the ground plane, respectively. The $Y_o$ dimension is the location of the feed point measured from the two center lines of the antenna element. The S dimension is the width of the notch. As the S dimension is increased, it has an effect of increasing the resonant frequency and vice versa. The angles $\theta$ and $\phi$ are measured per IRIG Standards. The above parameters are measured in inches and degrees.

Figure 2A:
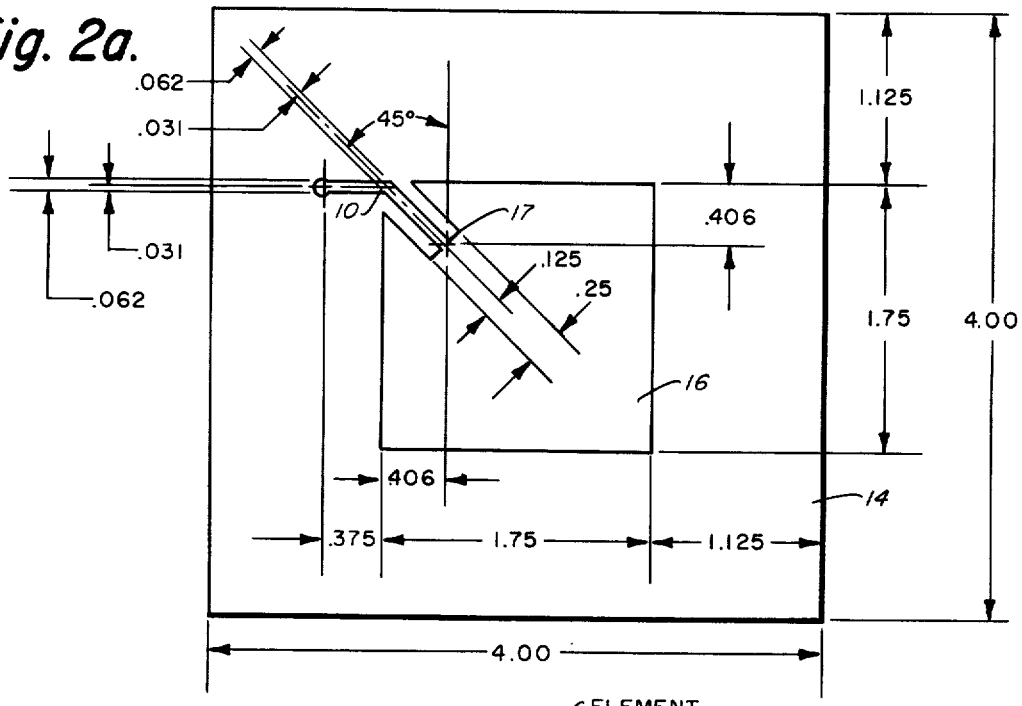
FIG. 2A is a planar view of a typical notched/diagonally fed electric microstrip dipole antenna.
Figure 2B:
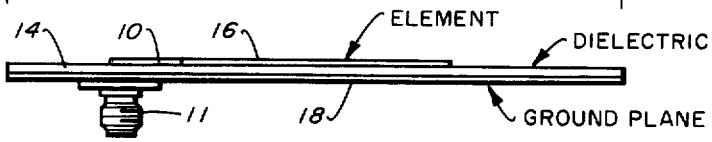
FIG. 2B is a side view of the antenna.

FIGS. 2A and 2B show a typical square notched/diagonally fed electric microstrip dipole antenna of the present invention. The typical antenna is illustrated with the dimensions give in inches, as shown in FIGS. 2A and 2B, by way of example, and the curves shown in later figures are for the typical antenna illustrated. The antenna is fed from a microstrip transmission line 10 and/or a coaxial-to-microstrip adapter 11, with the center pin of the adapter extending through the dielectric substrate to the end of the microstrip transmission line, as shown, or to feed point 17 on microstrip element 16, if fed directly with a coaxial feedline. The microstrip antenna can be fed with most of the different types of coaxial-to-microstrip launchers presently available. However, an advantage of the notched/diagonally fed microstrip antenna is that it can be fed and arrayed with microstrip transmission line etched along with the elements. The dielectric substrate 14 separates the element 16 from the ground plane 18 electrically.

As shown in FIG. 2A, the element 16 is fed in a notch on a diagonal of the element with respect to the A and B dimensions. The location of the $Y_o$ dimension along the A dimension is equal to the $Y_o$ dimension along the B dimension with the vector sum being the distance from the element center point to the feed point. The square element 16, when fed on a diagonal, operates in a degenerate mode, i.e., two oscillation modes occurring at the same frequency. These oscillations occur along the Y axis and also along the Z axis. Dimension A determines the resonant frequency along the Y axis and dimension B determines the resonant frequency along the Z axis. Other parameters contribute to a lesser degree to the resonant frequency. If the element is a perfect square, the resonant frequencies are the same and the phase difference between these two oscillations are zero. For this case, the resultant radiated field vector is along the diagonal and in line with the feed point. Mode degeneracy in a perfectly square element is not detrimental. The only apparent change is that the polarization is linear along the diagonal and in line with the feed point instead of in line with the oscillations. All other properties of the antenna remain as if oscillation is taking place in one mode only.

Pertinent design equations that are sufficient to characterize this type of antenna are presented.

Design equations for the notched/diagonally fed microstrip antenna are subject to change with slight variation in the antenna element dimension. This is particularly true with the antenna gain, antenna radiation pattern, antenna bandwidth and the antenna polarization. For this reason, the combined radiation fields are not presented. It is much easier to understand the operation of the notched/diagonally fed antenna if the A mode of oscillation properties are presented first and, where applicable, relate to the B mode of oscillation.

Before determining the design equations for the A mode of oscillation, the following statements are given:

1. The A mode of oscillation and the B mode of oscillation are orthogonal to one another and as such the mutual coupling is minimum.
2. If both the A mode of oscillation and the B mode of oscillation have the same properties, one-half of the available power is coupled to the A mode and one-half is coupled to the B mode of oscillation.
3. The combined input impedance is the parallel combination of the impedance of the A mode of oscillation and the B mode of oscillation.
4. Since the A mode of oscillation is orthogonal to the B mode of oscillation, the properties of each mode of oscillation can be determined independently of each other and a few of the combined properties can be determined in the manner prescribed above.
5. Only a slight change in the element dimension will cause a large change in some of the antenna properties.

For example, it will be shown later than less than 0.5% change in the element dimension can cause the polarization to change from linear along the diagonal to near circular.

Design Equations

The design equations are shown for the A mode of oscillation. In most cases, the equations obtained from the A mode of oscillation apply also to the B mode of oscillation since the A dimension is assumed to be equal to the B dimension.

Antenna Element Dimension

The equation for determining the length of the antenna element when A = B is given by $$A = \frac{[1.18 \times 10^{10} - F \times 4 \times H \times \sqrt{\epsilon}\,]}{\left[2 \times F \times \sqrt{1 + 0.61 \times (\epsilon - 1) \times \left(\frac{A}{H}\right)^{0.1155}}\right]} \quad (1)$$

where $x$ = indicates multiplication $F$ = center frequency (Hz)

$\epsilon$ = the dielectric constant of the substrate (no units).

In most practical applications, F, H and $\epsilon$ are usually given. As seen from equation (1), a closed form solution is not possible for the square element. However, numerical solution can be accomplished by using Newton's Method of Successive Approximation (see U.S. National Bureau of Standards, Handbook of Mathematical Functions, Applied Mathematics Series 55, Washington, D.C. GPO, November 1964) for solving equation (1). Equation (1) is obtained by fitting curves to Sobol's equation (Sobol, H. "Extending IC Technology to Microwave Equipment," ELECTRONICS, Vol. 40, No. 6, Mar. 20, 1967, pp. 112–124). Modification is needed to account for end effects when the microstrip transmission line is used as an antenna element. Sobol obtained his equation by fitting curves to Wheeler's conformal mapping analysis (Wheeler, H. "Transmission Line Properties of Parallel Strips Separated by a Dielectric Sheet," IEEE TRANSACTIONS, Microwave Theory Technique, Vol. MTT-13, No. 2, March 1965, pp. 172–185).

Radiation Pattern

The radiation patterns for the $E_{\theta_A}$ field and the $E_{\phi_A}$ field are usually power patterns, i.e., $|E_{\theta_A}|^2$ and $E_{\phi_A}|^2$, respectively.

The electric field for this antenna is given by $$E_{\theta_A} = \frac{jI_m Z_{o_A} e^{-jkr}}{\sqrt{2} \times 2\lambda r}[U \times \cos\phi + T \times \sin\theta] \quad (2)$$

and $$E_{\phi_A} = \frac{jI_m Z_{o_A} e^{-jkr}}{\sqrt{2} \times 2\lambda r}[U \times \sin\phi \cos\theta] \quad (3)$$

where $U = (U2 - U3)/U5$ $T = (T3 - T4)/T8$ $U2 = P \sin(A \times P/2)\cos(k \times A \times \sin\theta \sin\phi/2)$ $U3 = k \sin\theta \sin\phi \cos(A \times P/2)\sin(k \times A \times \sin\theta \sin\phi/2)$ $U5 = (P^2 - k^2 \sin^2\theta \sin^2\phi)$ $T3 = P \sin(P \times B/2)\cos(k \times B \times \cos\phi/2)$ $T4 = k \cos\theta \cos(P \times B/2)\sin(k \times B \times \cos\theta/2)$ $T8 = (P^2 - k^2 \cos^2\theta)$ $\lambda$ = free space wavelength (inches)

$\lambda_g$ = waveguide wavelength (inches)

$\lambda_{g_A}$ = waveguide wavelength (inches) and $\lambda_{g_A} \approx 2 \times A + (4 \times H/\sqrt{\epsilon})$ $j = (\sqrt{-1})$ $I_m$ = maximum current (amps)

$P = 2\pi/\lambda_g$ $k = 2\pi/\lambda$ $e$ = base of the natural log $r$ = the range between the antenna and an arbitrary point in space (inches)

$Z_o$ = characteristic impedance of the element (ohms) and $Z_{o_A}$ is given by $$Z_{o_A} = \frac{377 \times H}{\sqrt{\epsilon} \times B \times \left[1 + 1.735\,(\epsilon^{-0.0724})\left(\frac{H}{B}\right)^{0.836}\right]}$$

therefore $$|E_{\phi_A}|^2 = \frac{I_m^2 Z_o^2}{8\lambda^2 r^2}[U \times \cos\phi + T \times \sin\theta]^2$$

and $$|E_{\phi_A}|^2 = \frac{I_m^2 Z_o^2}{8\lambda^2 r^2}[U \times \sin\phi \cos\theta]^2$$

Since the gain of the antenna will be determined later, only relative power amplitude as a function of the aspect angles is necessary. Therefore, the above equations may be written as $$|E_{\phi_A}|^2 = \text{Const} \times [U \times \cos\phi + T \times \sin\theta]^2 \quad (6)$$

and $$|E_{\theta_A}|^2 = \text{Const} \times [U \times \sin\phi \cos\theta]^2 \quad (7)$$

The above equations for the radiation patterns are approximate since they do not account for the ground plane effects. Instead, it is assumed that the energy emanates from the center and radiates into a hemisphere only. This assumption, although oversimplified, facilitates the calculation of the remaining properties of the antenna. However, a more accurate computation of the radiation pattern can be made.

Radiation Resistance

Calculation of the radiation resistance entails calculating several other properties of the antenna. To begin with, the time average Poynting Vector is given by $$P_{av_A} = R_e(\overline{E} \times \overline{H}^*)/2 = (|E_{\theta_A}|^2 + |E_{\phi_A}|^2)/(2 \times Z_{o_A}) \quad (8)$$

where

* indicates the complex conjugate when used in the exponent $R_e$ means the real part, and $X$ indicates the vector cross product.

-continued $$P_{av_A} = \frac{Z_{o_A} I_m^2}{16\lambda^2 r^2} [U^2 \times \cos^2\phi + 2 \times T \times U \times \sin\theta \cos\phi + T^2 \times \sin^2\theta + U^2 \times \sin^2\phi \cos^2\theta] \quad (9)$$

The radiation intensity, $K_A$, is the power per unit solid angle radiated in a given direction and is given by $$K_A = r^2 \times P_{av_A} \quad (10)$$

The radiated power, $W$, is given by $$W = \int_0^{\pi} \int_{-\frac{\pi}{9}}^{\frac{\pi}{2}} K_A \times \sin\theta \, d\theta \, d\phi \quad (11)$$

The radiation resistance, $R_{a_A}$, is given by $$R_{a_A} = \frac{W}{I_{eff}} \quad (12)$$

where $$I_{eff} = \frac{I_{m_A}}{\sqrt{2}} \quad (13)$$

therefore $$R_{a_A} = \frac{2 \times W}{I_{m_A}^2} \quad (14)$$

$$R_{a_A} = \frac{Z_{o_A}}{8 \times \lambda^2} \int_0^{\pi} \int_{-\frac{\pi}{2}}^{\frac{\pi}{2}} [U^2 \times \cos^2\phi + 2 \times T \times U \times \sin\theta \cos\phi + T^2 \times \sin^2\theta + U^2 \times \sin^2\phi \cos^2\theta] \sin\theta \, d\theta \, d\phi \quad (15)$$

Numerical integration of the above equation can be easily accomplished using Simpson's Rule. The efficiency of the antenna can be determined from the ratio of the Q (quality factor) due to the radiation resistance and the Q due to all the losses in the microstrip circuit. The Q due to the radiation resistance, $Q_{R_A}$, is given by $$Q_{R_A} = (\omega \times L \times A)/(2 \times R_{a_A})$$

where $\omega = 2\pi F$ and $L$ is the inductance of a parallel-plane transmission line and can be found by using Maxwell's Emf equation, where it can be shown that $$L = Z_{o_A}/(F \times \lambda_g)$$

and $$\lambda_{g_A} = 2 \times A + (4 \times H/\sqrt{\epsilon})$$

The Q due to the radiation resistance, $Q_{R_A}$, is therefore given by $$Q_{R_A} = (\pi \times Z_{o_A} \times A)/(\lambda_{g_A} \times R_{a_A})$$

The Q due to the copper losses, $Q_{c_A}$, is similarly determined.

$$Q_{c_A} = (\omega \times L \times A)/(2 \times R_{c_A})$$

where $R_{c_A}$ is the equivalent internal resistance of the conductor. Since the ground plane and the element are made of copper, the total internal resistance is twice $R_{c_A}$, and $R_{c_A}$ is given by $$R_{c_A} = (R_s \times A/B)(\text{ohm})$$

where $R_s$ is the surface resistivity and is given by $$R_s = \sqrt{(\pi \times F \times \mu)/\sigma} \text{ (ohm)}$$

where $\sigma$ is the conductivity in mho/in. for copper and $\mu$ is the permeability in henry/in. $\sigma$ and $\mu$ are given by $$\sigma = 0.147 \times 10^7,$$

$$\mu = 0.0319 \times 10^{-6}$$

Therefore, the Q is determined using the real part of the input impedance $$Q_{c_A} = (\pi \times Z_{o_A} \times B)/(\lambda_{g_A} \times R_s)$$

The loss due to the dielectric is usually specified as the loss tangent, $\delta$. The Q, resulting from this loss, is given by $$Q_{D_A} = 1/\delta$$

The total Q of the microstrip antenna is given by $$Q_{T_A} = \frac{1}{\frac{1}{Q_{R_A}} + \frac{1}{Q_{c_A}} + \frac{1}{Q_{D_A}}}$$

The efficiency of the microstrip antenna is given by $$\text{eff} = Q_{T_A}/Q_{R_A}$$

Bandwidth

The bandwidth of the microstrip antenna at the half power point is given by $$\Delta f = F/Q_{T_A}$$

The foregoing calculations of Q hold if the height, H, of the element above the ground plane is a small part of a waveguide wavelength, $\lambda_{g_A}$, where the waveguide wavelength is given by $$\lambda_{g_A} \approx 2 \times A + (4 \times H/\sqrt{\epsilon})$$

If $H$ is a significant part of $\lambda_{g_A}$, a second mode of radiation known as the monopole mode begins to add to the microstrip mode of radiation. This additional radiation is not undesirable but changes the values of the different antenna parameters.

Gain

The directive gain is usually defined (H. Jasik, ed., Antenna, Engineering Handbook, New York McGraw-Hill Book Co., Inc., 1961, p. 3) as the ratio of the maximum radiation intensity in a given direction to the total power radiated per $4\pi$ steradians and is given by $$D_A = K_{max_A}/(W_A/4\pi)$$

The maximum value of radiation intensity, K, occurs when $\theta = 90°$ and $\phi = 0°$. Evaluating K at these values of $\theta$ and $\phi$, we have $$K_A \Big|_{\phi = 0°}^{\theta = 90°} = K_{max_A}$$

$$K_{max_A} = \frac{Z_{o_A} I_{in_A}^2}{16\lambda^2 p^2} [\sin (AP/2) + \sin (BP/2)]^2$$

since $$W_A = (R_{e_A} \times I_{in}^2)/2$$

$$D_A = \frac{Z_{o_A} \times \pi}{2R_{e_A} \times \lambda^2 \times P^2} [\sin (AP/2) + \sin (BP/2)]^2$$

for $A = B$ $$D_A = (2 \times Z_{o_A} \times A^2)/(R_{e_A} \times \lambda^2 \times \pi)$$

Typical calculated directive gains are 2.69 db. The gain of the antenna is given by $$G_A = D_A \times \text{efficiency}$$

Input Impedance

To determine the input impedance at any point along the notch/diagonally fed microstrip antenna, the current distribution may be assumed to be sinusoidal. Furthermore, at resonance the input reactance at that point is zero. Therefore, the input resistance is given by $$R_{in_A} = \frac{2 \times Z_{o_A}^2 \times \sin^2 (2\pi Y_o/\lambda_{g_A})}{R_{t_A}}$$

where $R_{t_A}$ is the equivalent resistance due to the radiation resistance plus the total internal resistance or $$R_{t_A} = R_{e_A} + 2R_{c_A}$$

The equivalent resistance due to the dielectric losses may be neglected.

The foregoing equations have been developed to explain the performance of the microstrip antenna radiators discussed herein and are considered basic and of great importance to the design of antennas in the future.

Antenna properties for the B mode can be determined in the same manner as given above for determining the properties for the A mode of oscillation. Since the A dimension equals the B dimension, the values obtained for the A mode are equal in most cases. Therefore:

$$Z_{o_A} = Z_{o_B}$$

$$R_{e_A} = R_{e_B}$$

$$Q_{R_A} = Q_{R_B}$$

$$Q_{c_A} = Q_{c_B}$$

$$Q_{T_A} = Q_{T_B}$$

$$\lambda_{g_A} = \lambda_{g_B}$$

$$G_A = G_B$$

$$R_{in_{(A)}} = R_{in_{(B)}}$$

$$R_{t_{(A)}} = R_{t_{(B)}}$$

Using the A mode equations for the B mode of oscillation saves rederiving similar equations.

In evaluating the combined properties of the notched/diagonally fed antenna:

$$R_{in_{(A,B)}} = \frac{1}{\frac{1}{R_{in_{(A)}}} + \frac{1}{R_{in_{(B)}}}}$$

The combined gain is given by $$G_{(A,B)} = G_{(A)} + G_{(B)}$$

The actual combined gain is normally evaluated at $K_{max_{(A,B)}}$ which turns out to be $G_{(A)} + G_{(B)}$.

The combined Q is given by $$Q_{T_{(A,B)}} = \frac{1}{\frac{1}{Q_{T_{(A)}}} + \frac{1}{Q_{T_{(B)}}}}$$

and the combined radiation resistance is given by $$R_{e_{(A,B)}} = \frac{1}{\frac{1}{R_{e_{(A)}}} + \frac{1}{R_{e_{(B)}}}}$$

If the B dimension is slightly smaller than the A dimension, a phase difference occurs between the two modes of oscillation. This can cause circular polarization to occur. This circular polarization is desired for some applications, particularly when it is obtainable with the use of microstrip transmission line or only a single coaxial-to-microstrip adapter without the use of phase shifters. The most outstanding advantage of the notched/diagonally fed microstrip dipole, as compared to most other microstrip antennas is the ease in the designing a singularly fed, circularly polarized microstrip dipole antenna.

The copper losses in the clad material determine how narrow the element can be made. The length of the element determines the resonant frequency of the antenna, as was mentined in the discussion earlier. However, as the S dimension the notch width, is increased it has the effect of slightly increasing the resonant frequency, and vice versa. The width of the notch, however, is generally determined by the width of the microstrip transmission line 10. It is preferred that both the length and the width of the ground plane extend at least one wavelength ($\lambda$) in dimension beyond each edge of the element to minimize backlobe radiation.

Typical antennas have been built using the above equations and the calculated results are in good agreement with test results.

In electric microstrip antennas, there are two modes of current oscillation orthogonal to one another; the current oscillation mode along the A dimension, and the current oscillation mode along the B dimension. Depending on the input impedance of each of these current modes, the field distribution may change from diagonal fields to circulating fields (i.e., circular or elliptical).

When the microstrip antenna is fed in a notch along the diagonal, two modes of oscillation can occur. If dimension A is equal to dimension B and both are equal to the resonant length $l$ for a specific frequency, the oscillation along the A length (A mode) and the oscillation along the B length (B mode) will have the same amplitude of oscillation. In addition, the phase between the A mode of oscillation will be equal to the phase of the B mode of oscillation. In such case, the polarization is linear.

If dimension A is made slightly shorter than the resonant length $l$, the input impedance for the A mode of oscillation will be inductive. This inductive impedance will have a retarding effect on the phase of the A mode of oscillation.

If dimension B is made slightly longer than the resonant length $l$, the input impedance for the B mode of oscillation will be capacitive. This capacitive impedance will have an advancing effect on the phase of the B mode of oscillation.

By definition, circular polarization can be obtained if there are two electric fields normal to one another, equal in amplitude and having a phase difference of 90°.

In this case of the notched/diagonally fed microstrip dipole antenna, there is the A mode of oscillation and the B mode of oscillation creating fields normal to one another. As previously mentioned, the phase of one mode of oscillation can be advanced and the phase of another retarded. If there is enough retardation and enough advance in the fields, a 90° phase can be obtained. The equal amplitude in each of the fields can be obtained by coupling the same amount of power into each mode of oscillation. This will provide circular polarization.

Any variation of the phase of the above fields or its amplitude will provide elliptical polarization (i.e., there must be some phase difference, but not necessarily amplitude difference). Elliptical polarization is the most general form of polarization. Both circular and linear polarizations are special cases of elliptical polarization. For linear polarization, only both phases need to be equal.

Design equations for obtaining circular polarization in the notched/diagonally fed electric microstrip antenna can be obtained by using transmission line theory. To begin with, the input impedance for an open circuited transmission line is given by $$Z_s = Z_o \frac{\cosh\alpha l \cos\beta l + j \sinh\alpha l \sin\beta l}{\sinh\alpha l \cos\beta l + j \cosh\alpha l \sin\beta l} \tag{16}$$

If both the A mode of oscillation and the B mode of oscillation are analyzed, equation (1) can be rewritten for the A mode as $$Z_{S_A} = Z_{o_A} \frac{\cosh\alpha_A l_A \cos\beta l_A + j \sinh\alpha_A l_A \sin\beta l_A}{\sinh\alpha_A l_A \cos\beta l_A + j \sinh\alpha_A l_A \sin\beta l_A} \tag{17}$$

and for the B mode as $$Z_{S_B} = Z_{o_B} \frac{\cosh\alpha_B l_B \cos\beta l_B + j \sinh\alpha_B l_B \sin\beta l_B}{\sinh\alpha_B l_B \cos\beta l_B + j \sinh\alpha_B l_B \sin\beta l_B} \tag{18}$$

where $\alpha_A$ and $\alpha_B$ are propagation constants for the antenna circuit, and $$\alpha_A = \frac{R_{t_A}}{A \times 2 \times Z_{o_A}}$$

$$\alpha_B = \frac{R_{t_B}}{B \times 2 \times Z_{o_B}}$$

$$\beta = \frac{2\pi}{\lambda_g}$$

$$\lambda_g = 2l + (4 \times H/\sqrt{\epsilon})$$

where $l$ is the resonant length for the frequency of interest. (It is not necessary to have the actual element length A at resonance. The element may be cut to a non-resonant length and made to resonate with a reactive load.) If there is deviation from a square element, $l$ is given by $$l = \frac{[1.18 \times 10^{10} - F \times 4 \times H \times \sqrt{\epsilon}]}{\left[2 \times F \times \sqrt{1 + 0.61 \times (\epsilon - 1) \times \left(\frac{1}{H}\right)^{0.1155}}\right]} \tag{19}$$

Since a closed form solution of $l$ is not possible, numerical solution can be accomplished by using Newton's Method of Successive Approximation.

If the A dimension is to be made slightly longer and the B dimension is to be made slightly shorter:

$$A = l + \Delta l_A$$

and $$B = l - \Delta l_B$$

$$Z_{o_A} = \frac{377 \times H}{\sqrt{\epsilon} \times B \times \left[1 + 1.735\,(\epsilon^{-0.0724})\left(\frac{H}{B}\right)^{0.836}\right]}$$

$$Z_{o_B} = \frac{377 \times H}{\sqrt{\epsilon} \times A \times \left[1 + 1.735(\epsilon^{-0.0724})\left(\frac{H}{A}\right)^{0.836}\right]}$$

Equations (17) and (18) can be simplified when the element is cut to resonant frequency, F.

At resonant frequency $\beta l = n\pi$ where $n = 1, 2, 3, \ldots$, and $n$ determines the order of oscillation. In this case, the order of oscillation is the first order and $\beta l = \pi$.

When the resonant waveguide length, $l_g$, is made longer by $\Delta l_A$, then:

$$l_A = l_g + \Delta l_A$$

and $$\beta l_A = \frac{2\pi n}{\lambda_g}(l_g + \Delta l_A)$$

If $n = 1$, then $$\beta l_A = \frac{2\pi l_g}{\lambda_g} + \frac{2\pi}{\lambda_g}\Delta l_a$$

-continued since $l_g = \frac{\lambda_g}{2}$ $$\beta l_A = \pi + \frac{2\pi\Delta l_A}{\lambda_g}.$$

Under these conditions $$\text{Cos}\,\beta l_A = -\cos\frac{2\pi\Delta l_A}{\lambda_g}$$

$$\text{Sin}\,\beta l_A = -\,\text{Sin}\frac{2\pi\Delta l_A}{\lambda_g}$$

Equation (17) can be written as $$Z_{S_A} = Z_{o_A}\frac{\text{Cosh}\,\alpha_A l_A\,\text{Cos}\frac{2\pi\Delta l_A}{\lambda_g} + j\,\text{Sinh}\,\alpha_A l_A\,\text{Sin}\frac{2\pi\Delta l_A}{\lambda_g}}{\text{Sinh}\,\alpha_A l_A\,\text{Cos}\frac{2\pi\Delta l_A}{\lambda_g} + j\,\text{Cosh}\,\alpha_A l_A\,\text{Sin}\frac{2\pi\Delta l_A}{\lambda_g}}$$

for moderately high Q antennas, the second term in the numerator is small and may be neglected compared to the other terms. Under these conditions $$\text{Cosh}\,\alpha_A l_A \approx 1,$$

$$\text{Sinh}\,\alpha_A l_A \approx \alpha_A l_A$$

$$\text{Cos}\frac{2\pi\Delta l_A}{\lambda_g} \approx 1,\ \text{Sin}\frac{2\pi\Delta l_A}{\lambda_g} \approx \frac{2\pi\Delta l_A}{\lambda_g}$$

Therefore, $Z_{S_A}$ may be written as $$Z_{S_A} = Z_{o_A}\frac{1}{\alpha_A l_A + j\frac{2\pi\Delta l_A}{\lambda_g}} \tag{20}$$

equation (18) can be simplified in a similar manner. In this case $$l_B = l_g - \Delta l_B$$

$$\beta l_A = \frac{n2\pi}{\lambda_g}(l_g - \Delta l_B)$$

if $n = 1$ $$\beta l_A = \frac{2\pi l_g}{\lambda_g} - \frac{2\pi\Delta l_B}{\lambda_g}$$

since $l_g = \frac{\lambda_g}{2}$ $$\beta l_A = \pi - \frac{2\pi\Delta l_B}{\lambda_g}$$

under these conditions $$\text{Cos}\beta l_B = -\text{Cos}\frac{2\pi\Delta l_B}{\lambda_g}$$

$$\text{Sin}\beta l_B = +\text{Sin}\frac{2\pi\Delta l_B}{\lambda_g}.$$

Equation (18) can be written as $$Z_{S_B} = Z_{o_B}\left[\frac{-\text{Cosh}\,\alpha_B l_B\,\text{Cos}\left(\frac{2\pi\Delta l_B}{\lambda_g}\right) + j\,\text{Sinh}\,\alpha_B l_B\,\text{Sin}\left(\frac{2\pi\Delta l_B}{\lambda_g}\right)}{-\text{Sinh}\,\alpha_B l_B\,\text{Cos}\left(\frac{2\pi\Delta l_B}{\lambda_g}\right) + j\,\text{Cosh}\,\alpha_B l_B\,\text{Sin}\left(\frac{2\pi\Delta l_B}{\lambda_g}\right)}\right]$$

for moderately high Q antennas, the second term in the numerator is small and may be neglected compared to other terms. Therefore $$\text{Cosh}\,\alpha_B l_B \approx 1,$$

$$\text{Sinh}\,\alpha_B l_B \approx \alpha_B l_B$$

$$\text{Cos}\left(\frac{2\pi\Delta l_B}{\lambda_g}\right) \approx 1,\ \text{Sin}\left(\frac{2\pi\Delta l_A}{\lambda_g}\right) \approx \frac{2\pi\Delta l_B}{\lambda_g}.$$

Therefore, $Z_{S_B}$ can be written as $$Z_{S_B} = Z_{o_B}\left(\frac{1}{\alpha_B l_B - j\frac{2\pi\Delta l_B}{\lambda_g}}\right) \tag{21}$$

For circular polarization, the following two conditions must be satisfied $$\tan^{-1}\left(\frac{2\pi\Delta l_A}{\alpha_A l_A \lambda_g}\right) + \tan^{-1}\left(\frac{2\pi\Delta l_B}{\alpha_B l_B \lambda_g}\right) = 90^\circ$$

and $$\alpha_A l_A = \alpha_B l_B$$

As can be observed, determination of $\Delta l_A$ and $\Delta l_B$ by manual computation is almost impossible. However, the problem can be solvable by use of a computer. A further reduction in the complexity of the problem is to assume $$\alpha_A \approx \alpha_B$$

which is a good assumption when $$\Delta l_A << \lambda_{g/10}$$

and $$\Delta l_B << \lambda_{g/10}$$

For these conditions $$l_A \approx l_B$$

Therefore, $$\tan^{-1}\left(\frac{2\pi\Delta l_A}{\alpha_A l_A \lambda_g}\right) \approx \tan^{-1}\left(\frac{2\pi\Delta l_B}{\alpha_B l_B \lambda_g}\right) \approx 45^\circ$$

and $$\Delta l_A \approx \Delta l_B \approx \frac{\alpha_A l_A \lambda_g}{2\pi} \approx \frac{\alpha_B l_B \lambda_g}{2\pi}$$

Figure 6:
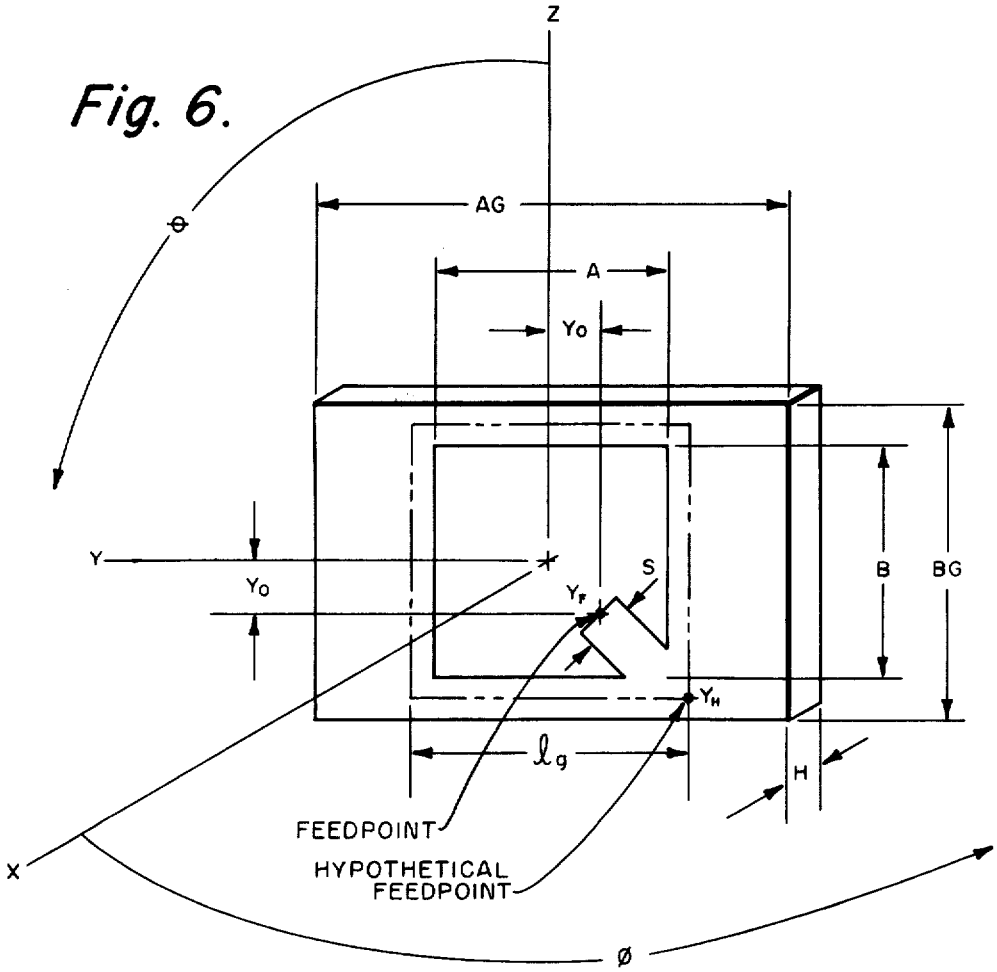
FIG. 6 shows the alignment coordinate system with a hypothetical feed point located beyond the corner of the element for the purpose of discussing circular polarization.

The foregoing discussion involves a hypothetical case where the feed point is located beyond the edges of the element at feed point $Y_H$, as shown in FIG. 6.

Similar analysis is made for determining the conditions for circular polarization at any feed point $Y_F$ on the diagonal for a typical notched/diagonally fed antenna.

Figure 7:
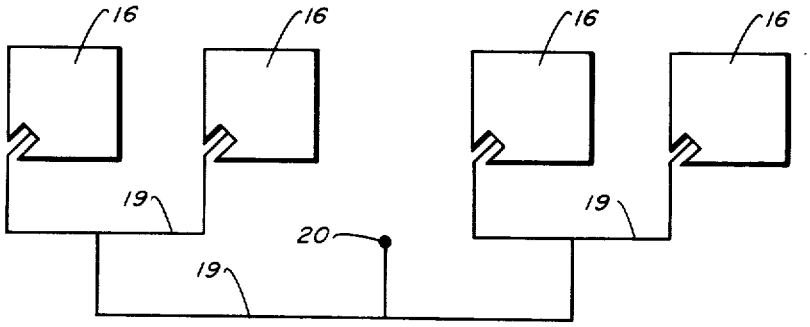
FIG. 7 shows a general arraying configuration using several antenna elements connected together with microstrip transmission lines.
Figure 4:
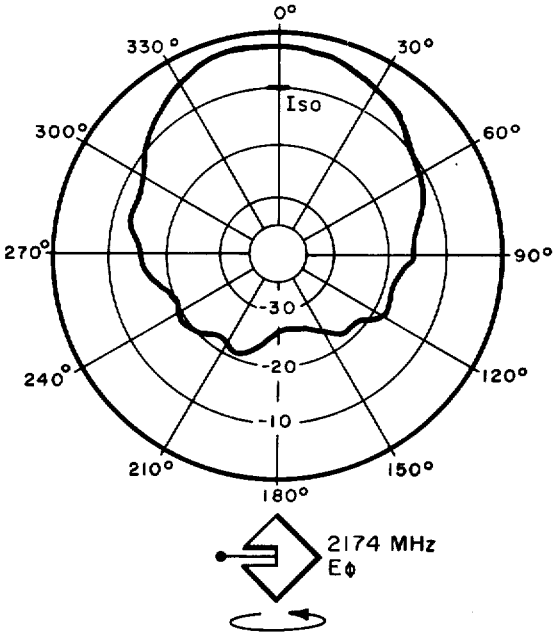
FIGS. 4 and 5 show the antenna radiation patterns for linear polarizations in a plane normal to the element along the diagonal containing the feed point for $E_\phi$ field and $E_\theta$ field polarization, respectively for the antenna shown in FIGS. 2A and 2B.
Figure 5:
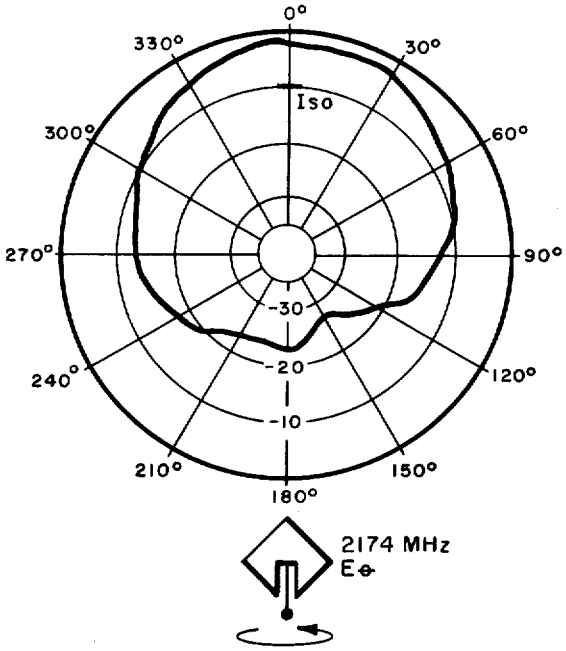

The notched/diagonally fed electric microstrip dipole antenna can be fed at the optimum feed point and also circular polarization can be obtained using only a single feed point. This eliminates the need for additional components that otherwise would be required for circular polarization. A plurality of elements can be arrayed easily using etched microstrip transmission line, such as shown in FIG. 7. It should be noted that the length of the notch can also slightly affect the resonant frequency.

Obviously many modifications and variations of the present invention are possible in the light of the above teachings. It is therefore to be understood that within the scope of the appended claims the invention may be practiced otherwise than as specifically described.

What is claimed is:

1. A notched/diagonally fed electric microstrip dipole antenna having low physical profile and conformal arraying capability, comprising:

a. a thin ground plane conductor;

b. a thin rectangular radiating element for producing a radiation pattern being spaced from said ground plane;

c. said radiating element being electrically separated from said ground plane by a dielectric substrate;

d. said radiating element having an optimum feed point located along a diagonal line of the element between the outer edge and the center point of said element;

e. said radiating element having a notch extending into said element from the outer edge thereof along said diagonal line of the element to said optimum feed point;

f. the resonant frequency of the antenna being determined primarily by the length of said radiating element; the width of said notch having a slight effect on the resonant frequency, as the notch width is increased the resonant frequency being increased slightly, and vice versa;

g. the antenna input impedance being variable to match most practical impedances as said feed point is moved along said diagonal line;

h. the antenna bandwidth being variable with the width of the radiating element and the spacing between said radiating element and said ground plane, said spacing between the radiating element and the ground plane having somewhat greater effect on the bandwidth than the element width;

i. said radiating element being operable to oscillate in two modes of current oscillation, each of said two modes being orthogonal to the other;

j. antenna polarization being linear when the radiating element length and width are equal, and the antenna polarization being circular when the phase difference between the two modes of oscillation are in quadrature due to differences between the length and width of the antenna.

2. An antenna as in claim 1 wherein the ground plane conductor extends at least one wavelength beyond each edge of said radiating element to minimize any possible backlobe radiation.

3. An antenna as in claim 1 wherein said thin rectangular radiation element is in the form of a square and the polarization is linear along the diagonal on which the feed point lies.

4. An antenna as in claim 1 wherein said radiating element is fed along said diagonal line at the feed point at the inner end of said notch with microstrip transmission line.

5. An antenna as in claim 1 wherein said radiating element is fed from a single coaxial-to-microstrip adapter, the center pin of said adapter extending through said ground plane and dielectric substrate to the feed point of said radiating element.

6. An antenna as in claim 1 wherein a plurality of said radiating elements are arrayed to provide a near isotropic radiation pattern.

7. An antenna as in claim 1 wherein a plurality of said radiating elements are arrayed with interconnecting microstrip transmission lines on a single dielectric substrate and fed from a single coaxial-to-microstrip adapter.

8. An antenna as in claim 1 wherein the length of said radiating element is approximately ½ wavelength.

9. An antenna as in claim 1 wherein said antenna radiation pattern can be varied from diagonal fields to circulating fields depending upon the input impedance of each of said two modes of current oscillation.

10. An antenna as in claim 1 wherein a slight change in the element length and width from being of equal dimension up to approximately 0.5% difference will result in changes in some antenna characteristics and cause the polarization to change from linear along the diagonal to near circular polarization.

11. An antenna as in claim 1 wherein the radiation pattern of said antenna is operable to be circularly polarized by advancing one mode of current oscillation and retarding the other mode of current oscillation until there is a 90° phase difference, and by coupling the same amount of power into each mode of oscillation.

12. An antenna as in claim 1 wherein the length of the antenna radiating element is determined using Newton's Method of successive approximation by the equation:

$$A = \frac{1.18 \times 10^{10} - F \times 4 \times H \times \sqrt{\epsilon}}{\left[2 \times F \times \sqrt{1 + 0.61 \times (\epsilon - 1) \times \left(\frac{4}{H}\right)^{0.1155}}\right]}$$

where $A$ is the length to be determined $F$ = the center frequency (Hz)

$H$ = the thickness of the dielectric $\epsilon$ = the dielectric constant of the substrate.

13. An antenna as in claim 12 wherein the radiation patterns for each mode of oscillation are power patterns, $|E_\theta|^2$ and $|E_\phi|^2$, polarization field $E_\phi$ and the field normal to the polarization field $E_\theta$, and are given by the equations:

$$|E_\phi|^2 = \frac{I_m^2 Z_0^2}{4\lambda^2 r^2} [U \times \cos\phi + T \times \sin\theta]^2$$

and $$|E_\phi|^2 = \frac{I_m^2 Z_0^2}{4\lambda^2 r^2} [U \times \sin\phi \cos\theta]^2$$

where $U = (U2 - U3)/U5$ $T = (T3 - T4)/T8$ $U2 = P \sin(A \times P/2) \cos(k \times A \times \sin\theta \sin\phi/2)$ $U3 = k \sin\theta \sin\phi \cos(A \times P/2) \sin(k \times A \times \sin\theta \sin\phi/2)$ $U5 = (P^2 - k^2 \sin^2\theta \sin^2\phi)$ $T3 = P \sin(P \times B/2) \cos(k \times B \times \cos\theta/2)$ $T4 = k \cos\theta \cos(P \times B/2) \sin(k \times B \times \cos\theta/2)$ $T8 = (P^2 - k^2 \cos^2 \theta)$ $I_m$ = maximum current (amps)

$P = 2\pi/\lambda_g$ $k = 2\pi/\lambda$ $\lambda$ = free space wavelength (inches)

$\lambda_g$ = waveguide wavelength (inches) and $\lambda_g \approx 2 \times A + (4 \times H/\sqrt{\epsilon})$ $r$ = the range between the antenna and an arbitrary point in space (inches)

$Z_o$ = characteristic impedance of the element (ohms) and $Z_o$ is given by $$Z_o = \frac{377 \times H}{\sqrt{\epsilon} \times B \times \left[1 + 1.735\,(\epsilon^{-0.0724})\left(\frac{H}{B}\right)^{0.836}\right]}$$

$H$ = the thickness of the dielectric $B$ = the width of the antenna element $\epsilon$ = the dielectric constant of the substrate (no units).

14. An antenna as in claim 1 wherein the minimum width of said radiating element is determined by the equivalent internal resistance of the conductor plus any loss due to the dielectric.

15. An antenna as in claim 1 wherein the input impedance, $R_{in}$, is given by the equation $$R_{in} = \frac{2 \times Z_o^2 \times \sin^2(2\pi\ Yo/\lambda_g)}{R_a + 2R_c}$$

where $R_a$ = the radiation resistance $2R_c$ = the total internal resistance $Z_o$ = characteristic impedance of the element, and $Y_o$ = distance of feed point from the center of the element.

16. An antenna as in claim 1 wherein only a slight difference exists between the element length and width from being of equal dimension and the polarization is circular; the amount said radiating element length is increased from the equal dimension is determined by the equation $$\Delta l_A \approx \frac{\alpha_A l_A \lambda_g}{2\pi}$$

and the amount said radiating element width is decreased from the equal dimension is determined by the equation $$\Delta l_B \approx \frac{\alpha_B l_B \lambda_g}{2\pi}$$

where:

$\alpha_A$ and $\alpha_B$ are propagation constants for the antenna circuit, $l_A$ is the length of the antenna radiating element, $l_B$ is the width of the antenna radiating element, $\lambda_g$ is the waveguide wavelength.

17. An antenna as in claim 1 wherein each of the two modes of oscillation have the same properties and one-half of the available power is coupled to one mode of oscillation and one-half of the available power is coupled to the other mode of oscillation.

* * * * *